US009114899B2

(12) United States Patent
Jouin et al.

(10) Patent No.: US 9,114,899 B2
(45) **Date of Patent: *Aug. 25, 2015**

(54) LIQUID FILLED BOTTLE HAVING A COVER MEMBER WITH A LABEL FORMING EXTENSION

(71) Applicants: Frederic Jouin, L'Hay-les-Roses (FR); Christine Gehringer, Vinzier (FR); Jennifer Ostertag, Evian-les-Bains (FR)

(72) Inventors: Frederic Jouin, L'Hay-les-Roses (FR); Christine Gehringer, Vinzier (FR); Jennifer Ostertag, Evian-les-Bains (FR)

(73) Assignees: SA DES EAUX MINERALES D'EVIAN SAEME, Evian-les-Bains (FR); COMPAGNIE GERVAIS DANONE, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 14/364,720

(22) PCT Filed: Dec. 17, 2012

(86) PCT No.: PCT/EP2012/075859

§ 371 (c)(1),
(2) Date: Jun. 12, 2014

(87) PCT Pub. No.: WO2013/092529

PCT Pub. Date: Jun. 27, 2013

(65) Prior Publication Data

US 2014/0326727 A1 Nov. 6, 2014

(30) Foreign Application Priority Data

Dec. 19, 2011 (WO) ..... PCT/IB2011/003241

(51) Int. Cl.
*B65D 1/02* (2006.01)
*B65D 77/20* (2006.01)

(Continued)

(52) U.S. Cl.
CPC ..... *B65D 1/0238* (2013.01); *B65D 1/0253* (2013.01); *B65D 51/20* (2013.01); *B65D 77/2032* (2013.01); *G09F 3/04* (2013.01); *G09F 23/00* (2013.01); *G09F 23/06* (2013.01)

(58) Field of Classification Search
CPC ..... B65D 1/0238; B65D 1/0253
USPC ..... 220/270, 359.1, 359.2; 215/232; 206/459.5
See application file for complete search history.

(56) References Cited

U.S. PATENT DOCUMENTS 4,886,206 A 12/1989 Martinez
5,022,526 A 6/1991 Crum (Continued)

FOREIGN PATENT DOCUMENTS

DE 202008010071 U1 9/2005
DE 202010009034 U1 10/2010

(Continued)

OTHER PUBLICATIONS

International Search Report, dated Feb. 13, 2013, from corresponding PCT application.

*Primary Examiner* — Steven A. Reynolds
*Assistant Examiner* — King M Chu
(74) *Attorney, Agent, or Firm* — Young & Thompson

(57) ABSTRACT

The plastic bottle (1) is filled with liquid and provided with a neck (4) that defines a narrow opening (5) with an inner diameter typically inferior to 40 mm. A flexible sheet-like cover member (C), having a lower closing element (C1) and an upper label element (C2), is provided to seal the opening. A first portion (10) that defines a first surface of the label element is directly fastened to a central portion (6) of the closing element in contact with the upper face of the neck and reinforces this central portion. A second portion (L), which is entirely offset relative to the upper face of the neck, defines a second surface of the label element. The ratio between the second surface (S2) and the first surface (S1) is at least 1:2, and preferably at least 1:1. The second portion (L) extends above the shoulder 3 of the bottle.

21 Claims, 6 Drawing Sheets

(51) Int. Cl.

| | |
|---|---|
| ***B65D 51/20*** | (2006.01) |
| ***G09F 23/06*** | (2006.01) |
| ***G09F 3/04*** | (2006.01) |
| ***G09F 23/00*** | (2006.01) |

(56) References Cited

U.S. PATENT DOCUMENTS

| | | | | |
|---|---|---|---|---|
| 6,460,720 | B1 * | 10/2002 | Massey et al. | 220/359.1 |
| 8,225,954 | B1 * | 7/2012 | Triquet et al. | 220/359.2 |
| 2003/0230547 | A1 | 12/2003 | Seibel et al. | |
| 2005/0006333 | A1 * | 1/2005 | Merrill | 215/232 |
| 2008/0073308 | A1 * | 3/2008 | Yousif | 215/232 |
| 2009/0212060 | A1 | 8/2009 | Shinohara et al. | |
| 2010/0006587 | A1 | 1/2010 | Newmark | |
| 2011/0152821 | A1 * | 6/2011 | Kornfeld et al. | 604/403 |

FOREIGN PATENT DOCUMENTS

| | | | |
|---|---|---|---|
| EP | 0761560 | A1 | 3/1997 |
| FR | 2101015 | A1 | 3/1972 |
| GB | 222708 | A | 0/1903 |

* cited by examiner

LIQUID FILLED BOTTLE HAVING A COVER MEMBER WITH A LABEL FORMING EXTENSION

FIELD OF THE INVENTION

The present invention relates to containers provided with a neck and a narrow opening defined in the upper face of the neck and having a cover member for sealing the narrow opening, such as plastic bottles or similar containers used in food or non food packaging industry.

BACKGROUND OF THE INVENTION

In bottles of this type (of the International class B65D 1/02 according to the International Classification), the opening defined in the upper face of the neck must be sufficiently narrow for precisely pouring the liquid contained in the bottle and limiting risk of contamination. Other containers having a large opening such as cups, cylindrical recipients and containers having a general U or V-shape in cross-section are not adapted for such a purpose. Furthermore, risks of breakage at the opening during transport are higher with containers provided with apertures as wide as the body of the container. The invention does not relate to that category of containers but rather concerns containers with restricted apertures, which are typically sold with a flowable product inside and having a removable lid for sealing the aperture.

In order to obtain pouring convenience for the user, even when pouring the liquid into a cup of small capacity (typically less than 300 mL), the largest dimension of the narrow opening is generally inferior to 40 mm and typically inferior to 30 mm. Accordingly, a narrow opening means in the present specification an opening having its largest dimension inferior to 40 mm. Such a narrow opening is especially well adapted for direct drinking or for pouring the content of the bottle in a water cup having a maximum diameter inferior to 80 mm.

Bottles of this type also have to satisfy various constraints associated with their transport while having to be as light as possible in order to reduce costs associated with the quantity of plastic material used or with its transportation, and to reduce the impact on the environment. The food industry in particular has to propose packagings inexpensive and which generate as less as possible wastes.

Document EP 0 761 560 A1 discloses a glass or plastic receptacle whose neck is closed by a rectangular capsule and comprises an outer thread allowing use of a screw cap. The rectangular capsule comprises a closing portion heat sealed onto a ring defined at the top of the neck and having a disk-like shape. In the respective corners of the rectangular capsule, two tips are folded along the neck and fixed by heat sealing, while two other tips extend in the same plane as the closing portion and may be used to remove the capsule. Receptacles such a those disclosed in EP 0 761 560 A1 are provided with a sleeve label arranged around the body of the receptacle to display information about the content to the user.

Such receptacles still contain a significant amount of plastic material. A need thus still exists for developing liquid filled bottles with less plastic material and/or optimizing the use of plastic material in such sealed receptacles, and/or simplifying manufacturing processes.

SUMMARY OF THE INVENTION

A general object of the present invention is to provide liquid filled bottles having a narrow opening (the largest dimension thereof being typically inferior to 40 mm) with an improved use of the plastic material.

To this end, embodiments of the present invention provide a liquid filled bottle, comprising a cover member and a plastic bottle having a body, a rigid neck and a narrow opening sealed by the cover member, the narrow opening being defined in the upper face of the neck and surrounded by a ring of the neck, the cover member comprising:

- a one piece flexible closing element consisting essentially of a peelable film and comprising:
  - i) a central portion adhering with said ring and sealing the narrow opening of the bottle, and
  - ii) at least one margin portion extending around the central portion, the closing element having a circumference at least partly defined by said margin portion; and
- a one piece flexible label element defined by at least one layer of film material, said label element including a label portion;

wherein the closing element has a top face delimited by said circumference and defining a substantially planar support surface;

wherein said label element comprises a reinforcing portion directly fastened to all or a part of said support surface and entirely or partly covering said central portion, with the provision that at least an annular fixing portion covering the ring is covered by the reinforcing portion, the reinforcing portion defining a first surface;

and wherein the label portion defines a second surface that is entirely offset relative to the upper face of the neck, the ratio between the second surface and the first surface being superior or equal to 1:2 (and preferably superior to 3:4). The second surface can display label information, for instance about the composition and origin of the liquid content of the bottle.

The bottle has a narrow opening. By narrow opening, it is meant that the dimension of the opening is lower than the largest dimension of the body cross-section and preferably lower than the smallest dimension of the body cross-section and/or that the dimension of the opening is inferior to 40 mm, preferably inferior to 30 mm. It is understood that the height of the body is significantly greater than the size (typically a diameter) of the opening, preferably at least twice as large as the opening size.

The reinforcing portion of the label element creates an additional layer of material, which stiffens and reinforces the central portion that adheres on the ring defining the narrow opening. The fact that a reinforcing portion is bonded to the flexible film forming the closing element, by a layer of adhesive or possibly by a heat sealing bond, and not merely arranged against the inner side of an additional cap, provides a reinforcing effect. This reinforcing effect creates an area which remains more flat, and which is less subject to form waves or to crumple, even said area by the aperture is not made rigid. Moreover it improves the integrity of the cover member which can tear upon application of a sudden pressure, such as pressure applied when a bottle drops. This is of particular interest since narrow openings are subject to such pressures. It has been surprisingly found that tearing in such conditions can be suppressed. It should be noted that the fact of using a film-like or band device, that is to say one or several relatively thin elements, made of flexible material has advantages regarding the manufacturing and filling process of the packaging. In particular there is no need for an additional cap and no screwing is required in such a process using a plastic bottle.

The fact that the neck of the plastic bottle is rigid (without any flexibility) also appears important for improving the seal while keeping a narrow opening. The annular margin portion preferably defines a circumferentially continuous protection around the annular sealing area and prevents in particular migration from adhesive material or the like from the reinforcing portion to the sealing portion.

Advantageously, the cover member made of plastic material is provided for both sealing the bottle and displaying information, whereby the sleeve label becomes optional. The manufacturing process can be simplified, as the step of applying the sleeve can be omitted.

For bottles of small capacity (for instance between 150 mL and 500 mL), the label information can be easily read when the bottle is taken by hand in the gripping portion, while information displayed on a conventional sleeve label is masked by the hand. Furthermore, the neck may be of reduced height, without any thread. The height of the neck thus may be inferior or equal to 10 mm for instance.

According to a particular feature, the closing element comprises a pull tab adapted for removing the cover member from the ring of the neck, the pull tab protruding radially outwards beyond the ring. Unlike sealing membranes used in yogurt containers or similar containers having a non restricted aperture, the closing element can be removed faster and even a young child can easily remove the cover member as a whole because the dimensions of the narrow opening are not great as compared to the radial extension of the pull tab (such radial extension being the sum of the width of the ring and the distance between the free end of the pull tab and the outer edge of the ring). For instance the ratio between the diameter of the opening and the radial extension of the pull tab may be more than 1:2 and preferably between 2:3 and 1:1.

Preferably, the ratio between the second surface and the first surface is at least 1:1. Accordingly, when the label portion is formed as a side extension of the closing portion, the label portion has a circumference which may be at least equal to the circumference of the closing portion and all or part of label information can be significantly offset relative to the annular area. The first surface may be inferior to the support surface and the reinforcing portion preferably does not protrude beyond the circumference of the closing element, thus minimizing the amount of material in this reinforcing portion.

According to a particular feature, the pull tab has a free end that extends at a distance from the label element. With such an arrangement, the pulling action does not directly interfere with displaying of information through the label portion. This label portion can be easily bent (no stiffening effect due to the closing element) and for instance pasted to a portion of the plastic bottle.

According to another particular feature, the body of the bottle extends around a longitudinal axis, the closing element intersecting this longitudinal axis. The body determines an imaginary cylinder extending longitudinally around the longitudinal axis and the label portion comprises a free end, optionally pasted on the bottle, said free end entirely extending outside the imaginary cylinder when the free end is not pasted. Preferably, the ratio between the inner diameter of the narrow opening and the diameter of the imaginary cylinder is not superior to 1:1.5, preferably 1:2. With such an arrangement, the label portion has a great visibility, which contrasts with the small size of the reinforcing portion arranged above the narrow opening. A pack of 2, 4, 6 or more bottles may be easily provided with a good visibility of the label portion when each label portion is facing according to an outward direction relative to the pack.

In various embodiments of the bottle of the invention, recourse may optionally also be had to one or more of the following dispositions:

- each of the closing element and the label element is a plastic film.
- the label portion comprises a free end, the distance between this free end and the longitudinal axis being superior to the diameter of the imaginary cylinder.
- the closing element entirely extends within the imaginary cylinder. The free end of the pull tab is arranged within the imaginary cylinder. Preferably, the annular margin portion protrudes radially outwards with respect to the ring and a maximum of the radial extension of the margin portion is provided in the pull tab (as the opening is narrow, with a diameter inferior to 40 mm, the quantity of material used for the margin portion can be very small).
- the closing element is a peelable film having a maximal thickness inferior or equal to 300 μm, and the thickness is preferably constant; this maximal thickness is comprised between 5 and 200 μm for instance, and preferably between 10 and 100 μm, and even more preferably between 20 and 50 μm.
- the neck has a tubular shape and comprises an outer face extending downwardly from the ring, the ring protruding radially outwards from the outer face (the outer diameter defined by the ring being inferior to a diameter of the body).
- the neck has a tubular shape and comprises an inner face extending downwardly from the ring, the ring comprising an annular projection that protrudes radially toward the longitudinal axis from the inner face of the neck, the narrow opening having a size reduced by this annular projection (with such an arrangement, the annular fixing portion may be advantageously increased, without any impact on the external shape of the bottle).
- the flexible label element has a thickness inferior or equal to 100 μm and preferably not superior to the thickness of the closing element.
- the reinforcing portion defines a substantially disc-shaped crown having a determined diameter, the label portion comprising a free end provided with an edge having a length superior or equal to said determined diameter.
- the reinforcing portion essentially extends in a first plane, the label element comprising a junction portion adjacent the ring and arranged between the reinforcing portion and the label portion so as to cover a fraction of said margin portion of the closing element, the junction portion being narrower than the label portion.
- the label portion extends in a second plane intersecting the first plane at the junction portion;
- the junction portion is arranged between two notches to form a hinge or fold line.
- the label portion has two opposite sides, preferably rectilinear, each extending between the junction portion and the free end;
- the label element is marked with at least one of ink printing and engraving on said second surface, whereby the label portion displays label information;
- the label element is marked with ink printing on two second surfaces defined on two respective opposite faces of the label portion;
- the bottle is obtained by stretch-blow molding an injection-molded preform, the body being connected to the rigid neck of the bottle by a flexible shoulder, the label portion being pasted on said shoulder at a distance from the neck.

the liquid filled bottle only comprises one label defined by said label portion, the body being transparent and not covered by any additional layer of material.

the central portion of the closing element is fixed on the ring of the neck by heat sealing.

the fraction of the circumference is superior or equal to 1:12, and preferably comprised between 1:10 and 1:2;

the bottle can be a 150 mL, 200 mL, 250 mL, 330 mL, 500 mL, 750 mL, 1 L or 1.5 L bottle.

the bottle material can be a PolyEthylene Terephtalate (PET) material.

the closing element and/or the label element can comprise a PET material, for example a PET film optionally covered by a lacquer.

the bottle material can be a PolyEthylene Terephtalate (PET) material with each of the closing element and the label element comprising a PET material, for example a PET film optionally covered by a lacquer (using PET materials for the bottle and the cover member allows a simplified recycling).

the label element and the closing element are each cut before the sealing operation, and the label element is fastened to the closing element after marking label information and preferably before the sealing operation to seal the opening of the bottle.

the bottle may be filled with a liquid beverage, for instance a still liquid beverage and preferably mineral water.

DETAILED DESCRIPTION OF EMBODIMENTS

Figure 1:
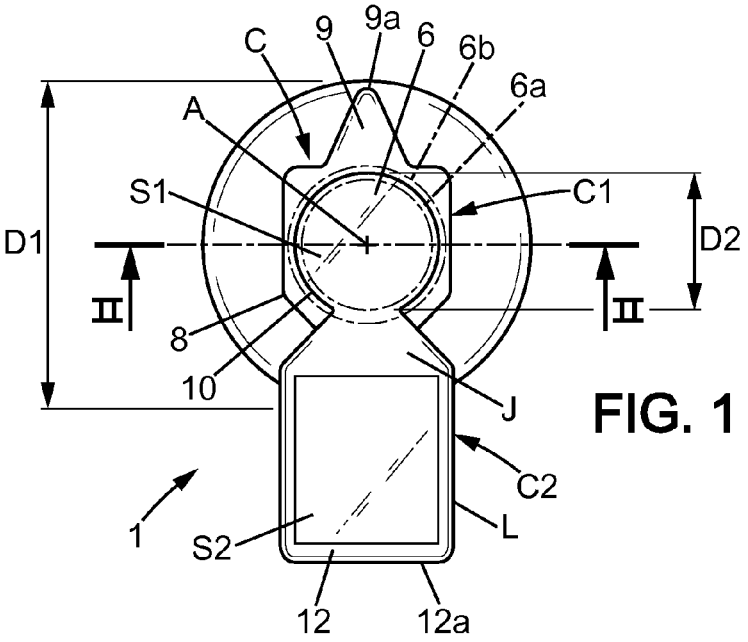
FIG. 1 is a top view of a liquid filled bottle in accordance with a first embodiment of the invention.

In the various figures, the same references are used to designate identical or similar elements.

Referring to FIGS. 1-3 and 5-6, the liquid filled bottle comprises a bottle 1 having a bottom 2 from which a body 3 extends longitudinally along a longitudinal axis A to a neck 4 which ends in a ring 4*a* forming a pouring opening 5. The body 3 has, from its base to its top, the bottom 2, a lower portion 3*a*, a gripping portion 3*b* and an upper portion 3*c* forming a shoulder of the bottle 1. The neck 4 is arranged as an extension of the upper portion 3*c* and here also extends longitudinally around the longitudinal axis A. This configuration is preferred because this prevents risks of breakage at the neck area during transport and the bottles 1 can be packaged with minimized empty spaces between them. Here, the body 3 has a tubular shape with a substantially circular cross-section and the longitudinal axis A may be a vertical central axis. However, it should be understood that other shapes may be provided and the neck 4 could be offset with respect to the longitudinal axis A or provided as a lateral extension of the body 3. The neck 4 is covered by a cover member C having a closing element C1. It can be seen in FIGS. 3-5 that the cover member C is a flexible sheet-like lid, the closing element C1 being a lower element of the cover member C.

Figure 5:
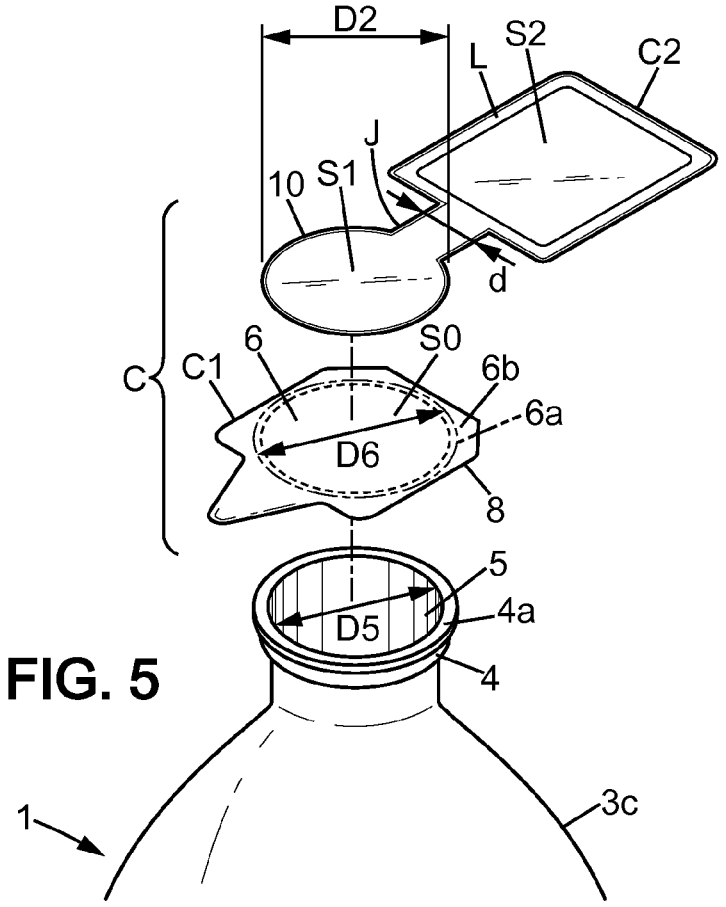
FIG. 5 is an exploded view in perspective showing the upper part of the bottle of FIG. 1.
Figure 6:
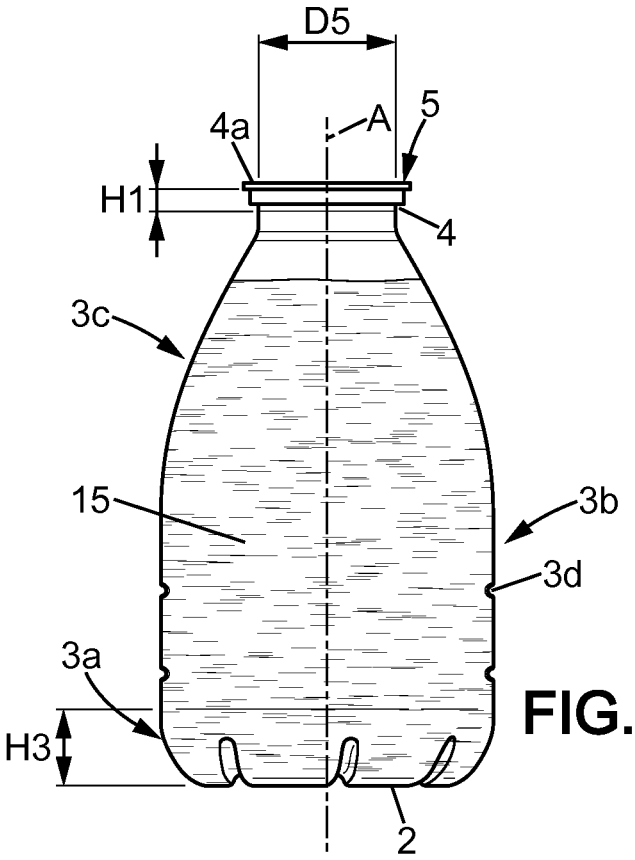
FIG. 6 shows a transparent plastic bottle filled with the liquid, before sealing by the cover member, the plastic bottle being adapted to be used in accordance with the first embodiment of the invention.

For comfortable pouring of the liquid 15 with a bottle 1 of more than 1-liter capacity, it is preferable if the gripping portion 3*b* is located above half-height of the bottle 1 but below three quarters of its total height, as shown in FIG. 5. The narrow opening 5 has a diameter D5 inferior to 30 mm (it can be seen that the neck diameter is significantly lower than the body diameter). For bottles of lower capacity, height H3 of the lower portion 3*a* may be reduced. Here, the gripping portion 3*b* has a form of a cylinder, while the upper portion 3*c* is tapered toward the neck 4. The height H1 of the neck 4 is inferior to 10 mm. Referring to FIG. 6, the height H1 of the neck 4 is inferior to 10% of the total height of the bottle 1, whose capacity is here comprised between 150 and 400 mL.

In this case, the bottle 1 may be formed from a single piece of plastic material, PET in the embodiment shown, which is shaped by heat blow-molding a preform in a mold. Heat blow-molding makes it possible to stretch the plastic material biaxially and to provide it with rigidity. Heat blow-molding also makes it possible to reduce the thickness of the wall of the body 3 considerably in relation to the thickness of the wall of the preform. This small thickness of the walls of the body 3 of the bottle 1, which may be of the order of 100 to 300 micrometers depending on the zone considered, is important for achieving a saving in material and therefore in weight.

The long shape of the body 3 may be obtained by a stretch blow molding process. The neck 4 is a rigid part present on the preform, which part is not modified during the operations of transforming the preform into a bottle 1.

Still referring to FIGS. 1-3 and 5-6, the neck 4 is here provided without any thread and thus can be of reduced height. The neck 4 can be closed by a film or similar thin layer of a flexible material, using a fixing material (layer of adhesive) deposited on the top annular surface defined by the ring 4*a* and/or using heat sealing, or deposited on the film.

Now referring to FIGS. 1, 3, 5 and 13, the liquid filled bottle 1 is provided with a cover member C having a closing element C1 made from a film material and a label element C2 defined by at least one layer of film material. A preferred film material is PET for the closing element C1. Same material and/or PP (polypropylene) can be used for the label element C2. The closing element C1 (as shown on the middle part of FIG. 5 or FIG. 13) is provided with a central portion 6 that entirely covers the ring 4*a* to seal the narrow opening 5. The central portion 6 of the closing element C1 adheres with said ring 4*a* at an annular fixing portion 6*a*. The central portion 6 is here defined as the part extending within the limits of the annular fixing portion 6*a* and has a size larger than the opening 5.

Figure 2:
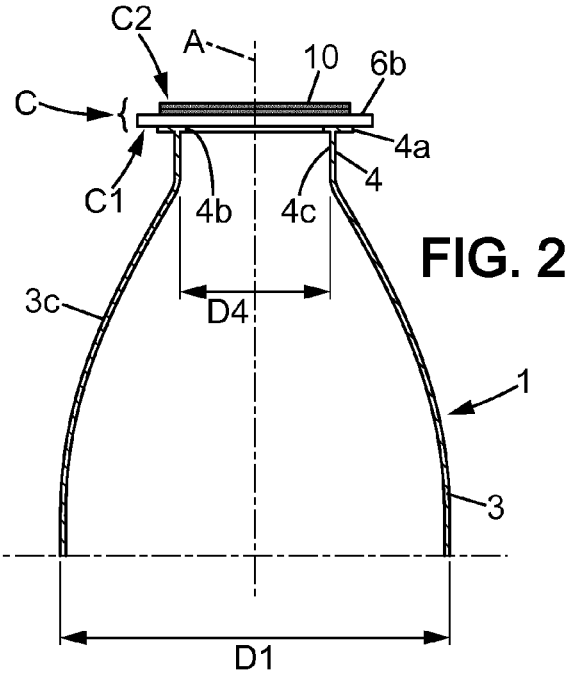
FIG. 2 is a vertical cross-section view taken through the bottle of FIG. 1.

As shown in FIG. 2, the ring 4*a* can optionally comprise an annular projection 4*b*, preferably of a circular shape, which protrudes radially toward the longitudinal axis A from the inner face 4*c* of the neck 4. The annular fixing portion 6*a* as shown in FIG. 1 may be enlarged as the opening 5 has a size which is reduced due to this annular projection 4*b*. As the ring 4*a* also protrudes radially outwards from the outer face of the neck 4, it is understood that the width (i.e. the radial extension) of the annular fixing portion 6*a* may be superior or equal to 1.5 or 2 mm for a bottle 1 of reduced capacity, for instance not superior to 500 mL. The fixing of the cover member C thus can be improved and risks of breakage are prevented. The radial extension of the annular projection 4*b* is preferably less than 1.5 mm. Surprisingly, the pouring convenience is not affected when the radial extension of the annular projection 4*b* is small, preferably less than 5% of the diameter D4 defined by the inner face 4*c* of the neck 4. It is also supposed that with the small radius of curvature of the opening 5 (with the diameter D5 for instance inferior or equal to 40 mm), such an annular projection 4*b* is not detrimental to the pouring operation. Of course, such an annular projection 4*b* may be suppressed. In this case, the width or radial extension of the annular fixing portion 6*a* is also superior or equal to 1.5 or 2 mm for the same kind of bottle 1, the ring 4*a* sufficiently protruding radially outwards from the outer face of the neck 4.

Figure 13:
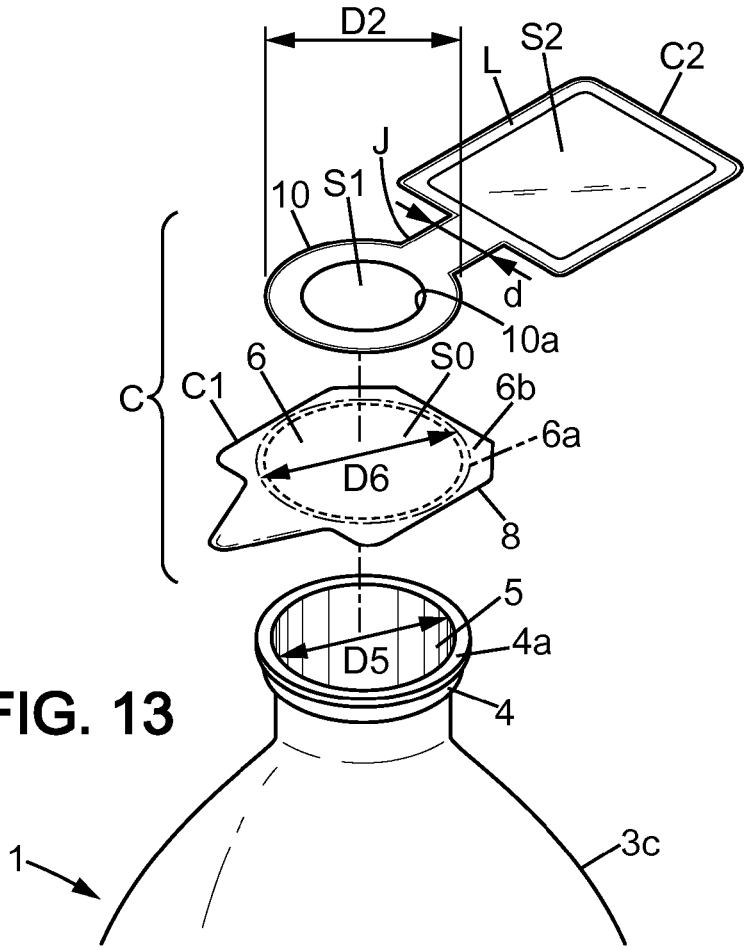
FIG. 13 is an exploded view in perspective showing the upper part of the bottle in a variant as compared to FIG. 5.

Referring to the FIGS. 5-6 and 13, the opening 5 has a general circular shape. The inner diameter D5 of the opening 5 is inferior to the diameter D6 or similar characteristic dimension of the central portion 6 (see FIG. 6). While the narrow opening 5 and the central portion 6 have been illustrated as a circular in the figures, it should be understood, that any other shape can be used, for instance an oval or oblong shape.

The closing element C1 is peelable and thus adapted for removal of the cover member C taken as a whole. Pulling a peripheral portion or any suitable extension of a margin portion 6*b*, here a pull tab 9, of the closing element C1 allows removing the central portion 6 from the ring 4*a*. In this example, the cover member C has a symmetry plane, which includes the longitudinal axis A, intersecting the pull tab 9 and the label portion L of the label element C2. The pull tab 9 and the label portion L are at opposite angular positions with respect to the longitudinal axis A as shown in FIG. 1.

One or more margin portions 6*a* extend around the central portion 6. Referring to the examples of FIGS. 1 and 3-5, the closing element C1 has here a circumference 8 entirely defined by a single margin portion 6*b* that continuously surrounds the central portion 6. The circumference 8 can be substantially defined by the outer edge of this annular margin portion 6*b*. Here, the margin portion 6*b* is superimposed to the outer edge of the ring 4*a* and is provided with an optional pull tab 9 that protrudes radially outwards relative to the neck 4 and is adapted for removing the cover member C from the ring 4*a*. As shown in FIG. 2, other parts than the pull tab 9 may also slightly protrude radially outwards beyond the ring 4*a*.

Figure 3:
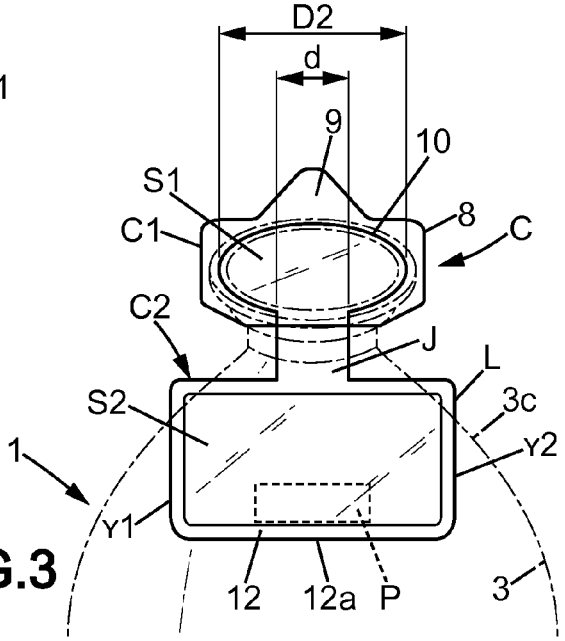
FIG. 3 is a perspective view showing the upper part of the bottle using a slight variant of the label portion of FIG. 1.

The closing element C1 has a top face delimited by the circumference 8 and defining a substantially planar support surface S0, as shown in FIG. 5. The flexible label element C2 comprises a reinforcing portion 10 directly fastened to the support surface S0 and entirely covering the central portion 6. The label element C2 also comprises a label portion L formed as an extension from the reinforcing portion 10, this label portion L extending above the upper portion 3*c* of the body as shown in FIG. 3. Here, the label portion L has a rectangular shape. It is advantageous to stick the closing element C1 and the label element C2 together for a quick removing of the cover member C (removed as one block).

Figure 4:
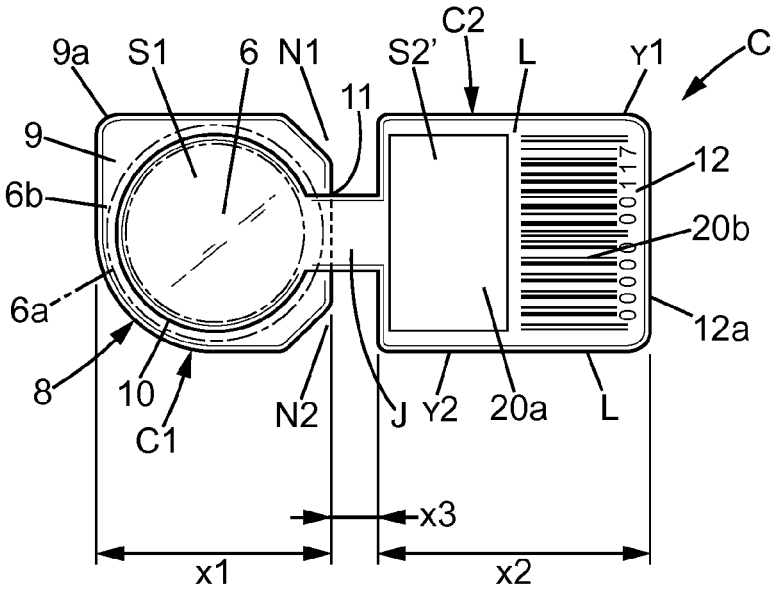
FIG. 4 shows a slight variant of the cover member of FIG. 1.

In the first embodiment shown in FIGS. 1-3 and 5 and in the variant of FIG. 4 or in the variant of FIG. 13 as well, the reinforcing portion 10 defines a substantially disc-shaped crown having a determined diameter D2. The inner diameter D5 of the opening is inferior to this diameter D2 and the annular fixing portion 6*a* of the central portion 6 is preferably continuously covered by the reinforcing portion 10 that creates an additional layer of material, thus stiffening and reinforcing the central portion 6. FIG. 13 illustrates a ring-like reinforcing portion 10 that defines an opening 10*a* (thus saving material). The reinforcing portion 10 may be directly fastened to all or a part of the support surface S0. The reinforcing portion 10, when shaped as a ring in particular, partly covers the central portion 6.

Referring to FIG. 4, it can be seen that the reinforcing portion 10 may be of smaller size than the ring 4*a* of the neck 4, so as to save material. In this case, the reinforcing portion 10 also covers (but partly) the ring 4*a*. This ensures that the opening 5 and the associated surround of the ring 4*a* are successively covered by the central portion 6 of the closing element C1 and by the reinforcing portion 10. It can also be seen on FIGS. 3-4 that the free end 12 of the label portion L is provided with an edge 12*a* having a length superior or equal to the diameter D2 of the reinforcing portion 10.

The reinforcing portion 10 defines a first surface S1, which may be optionally used to display information. The label portion L defines a second surface S2 that is entirely offset relative to the upper face of the neck 4.

Here, the two opposite sides y1, y2 of the label portion L are rectilinear, each extending between a junction portion J and the free end 12 remote from the reinforcing portion 10. As compared to a conventional pull tab provided with a free end 9*a*, the label portion L has more significant dimensions allowing display of information related to the composition and origin of the content or other relevant information. The free end 9*a* of the tab 9 here extends at a distance from the label portion L, preferably in the opposite region.

Preferably, the reinforcing portion 10 does not reinforce the optional pull tab 9. More generally, the cut of the reinforcing portion 10 does not correspond to the cut of the margin portion 6*b* of the closing element C1 so that there is at least a fraction of the margin portion 6*b* that can be quickly identified as different from the label element C2 and can be used as pull tab 9. In one preferred embodiment, the closing element C1 can be made of a transparent or colourless plastic material while the film defining the label element C2 is opaque or coloured respectively, thus increasing the visual contrast between the pull tab 9 and the reinforcing portion 10 of the label element C2.

The closing element C1 is a peelable film having a thickness inferior or equal to 300 μm and preferably inferior or equal to 200 m, and more preferably not superior to 150 μm. The closing element C1 is sufficiently resistant to be pulled without any deterioration. The flexible label element C2 may advantageously be substantially as thin as or thinner than the closing element C1, preferably inferior or equal to 100 μm. For instance, the thickness of the flexible label element C2 is about 50 μm, thus defining a very thin sticker. The flexible label element C2 may be of a slightly higher thickness when these elements C1-C2 are provided with a thickness significantly inferior to 100 μm. As a way of example, the closing element C1 can have a constant thickness comprised between 5 and 200 μm, and preferably between 10 and 100 μm. For instance, this thickness is about 36 μm. There is no particular need for any other additional reinforcing layer in the preferred embodiments. The label element C2 may be applied as a sticker that adheres on the closing element C1. Preferably, the reinforcing portion 10 is provided with an adhesive thereon for attachment onto the support surface S0 of the closing element C1.

As shown in FIGS. 2-3, the reinforcing portion 10 of the multilayer film that defines the label element C2 can be centered with respect to the longitudinal axis A and has here a diameter D2 or similar characteristic dimension significantly inferior to the diameter D1 or similar characteristic dimensions of the body 3. The quantity of material for making the reinforcing portion 10 is thus minimized as compared to the capacity of the bottle 1. Of course, it will be appreciated that the respective thicknesses of the closing element C1 and of the label element C2 have been enlarged in FIG. 2 for a better representation.

As shown in FIGS. 1 and 3-5, the label portion L defines a second surface S2, at least as large as the first surface S1, where label information is marked. This surface S2 is entirely offset relative to the annular area defined by the annular fixing portion 6*a*. Accordingly, adequate visibility of the label information is obtained once the cover member C is fixed by the central portion 6 onto the top of a liquid filled bottle 1. FIG. 4 shows the other face of the cover member C, where an additional second surface S2' is defined by the label portion L.

In the non-limitative example of the figures, the single piece label element C2 is here marked with ink printing or any other marking technology on the second surface S2 and optionally on other surfaces S2' defined on at least one of the two respective opposite faces of the label portion L. Moreover, the top surface of the reinforcing portion 10 may advantageously be marked in a similar manner.

In FIG. 4, it can be seen that the back of the label portion L may be partitioned into at least one area 20*a* with alphanumeric, pictograms and/or pictorial information and at least one area with coded information (for instance displaying a barcode 20*b*). The surface S2' displaying label information may extend on all or part of the back of the label portion L. In this example, the pull tab 9 is not traversed by a symmetry plane of the cover member C (this symmetry plane containing the longitudinal axis A).

Figure 7:
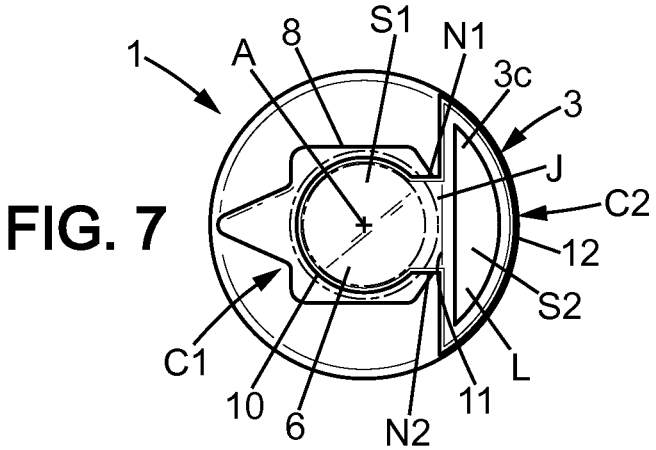
FIG. 7 is a top view of a liquid filled bottle in accordance with a second embodiment of the invention.

While FIGS. 1 and 3-5 show a label portion L of area at least equal to the area of the closing portion 6, a ratio about 3:4 (this ratio being preferably not inferior to 1:2) between the surfaces S2 and S1 may also be satisfactory as shown in FIG. 7. In this second embodiment, the reinforcing portion 10 is similar to the reinforcing 10 portion show in FIGS. 1, 3 and 5 but the surface S2 defined by the label portion L is smaller. In this case, the barcode 20*b* could be removed from the top face of the label portion L (and possibly displayed on the other face). It should be also noted that the closing element C1 is unchanged as compared to FIGS. 1, 3 and 5.

In order to increase visibility of the label information displayed by the label portion L, the label element C2 of the cover member C may be provided with at least one and preferably two notches N1, N2. A junction portion J (here narrower than the central portion 6) is arranged between the two notches N1, N2 to form a hinge 11 or a hinge area. The label portion L thus may be optionally inclined relative to a first plane in which the central portion 6 extends. In this case, the label portion L extends in a second plane intersecting the first plane at the junction portion J.

Of course, those skilled in the art will choose a length d of the junction portion J, which is sufficient so as to prevent separation of the label portion L. The length d of the junction J is for instance superior to 6 mm and inferior to the length of the edge 12*a*, preferably inferior to half of the length of the edge 12*a*. Preferably, the length d of the junction J is not inferior to the half of the diameter D2. It can be seen that when the label portion L is rectangular, the length d of the junction J and the length of the edge 12*a* of the free end 12 are measured according to a same direction perpendicular to the longitudinal axis A.

The fact that the edge 12*a* is much longer than the length d of the junction J is preferred in embodiments where the free end 12 can be pasted on the body 3 of the bottle 1. Referring to FIG. 3, the surface P of the label portion L to be pasted on the upper part 3*c* of the body 3 may be increased. In this example, the length of the surface P is superior to the length d of the junction J. The surface P is defined at a distance from the neck 4.

The paste material may be fixed more strongly to either the bottle 1, or the label portion L. The ratio between the length d of the junction J and the length of the label portion L, measured according to the same horizontal direction, is comprised between 1:5 and 2:3.

With a folding of the label portion L relative to the reinforcing portion 10, label information may be easily read from a lateral position. The label portion L can be considered as a loose flap with an angular deviation relative to the closing element C1 and the reinforcing portion 10 (the angle being for instance comprised between 10 and 80)°.

It can be seen in FIGS. 1, 3-5 and 7, that the junction portion J is adjacent to the ring 4 and arranged between the reinforcing portion 10 and the label portion L along a fraction of the circumference 8 of the closing element C1. Here, this fraction is a minoritary fraction so that the label portion L is formed as a side extension but, more generally, the fraction could be comprised between 1:12 and 1:1. In the examples of FIGS. 1-5, 7-9 and 11 this fraction is comprised between 1:6 and 1:2. In the example of FIG. 10 this fraction is slightly superior to 1:2, while in the example of FIG. 12 the junction portion J continuously surrounds the reinforcing portion 10. A fraction above 1:12 corresponds to a good compromise, in order to avoid breakage of the label portion L during transport of the liquid filled bottle 1, while minimizing the thickness of the label member C2.

When fixed, the cover member C will be capable of containment of pressures which may be produced in the bottle 1 above the liquid 15 while enabling facile opening of said cover member C by pulling the pull tab 9 or the label portion L in a movement generally parallel to the longitudinal axis A. Using the label portion L for removing the cover member C is less preferred because there is a risk of only removing the label element C2 (then the user should remove the closing element C1 using the pull tab 9 or similar part of the margin portion 6*b*).

The tensile strength of the plastic film used for making the closing element C1 may be comprised for instance between 40 and 300 N/m$^2$, preferably between 50 and 200 N/m$^2$. The label element C2 that comprises the label portion L and the reinforcing portion 10 to be fixed as a top portion onto the top of the closing element C1 is integrally formed in bendable plastic film. The plastic film may be obtained using a flexible multilayer sheet plastic so that both faces of the label portion L may be marked with information, for instance by ink printing.

Now referring to FIGS. 1 and 8-12, the label portion L protrudes beyond the imaginary encasing body 13 determined by the body 3, which may have the form of a cylinder, cone, prism or pyramid. The neck 4 and the reinforcing portion 10 here remain inside this imaginary encasing body 13 and the reinforcing portion 10 intersects the longitudinal axis A. According to FIGS. 8 and 9, the body 3 determines an imaginary cylinder (this imaginary cylinder having no upper limit) or similar encasing body 13 that extends longitudinally around this longitudinal axis A without any upper limit. This configuration is also used in FIGS. 1 and 11-12. The longitudinal axis A of the bottle body 3 is here a central axis of symmetry for both the body 3 and the neck 4. In this case, the imaginary encasing body 13 is a virtual cylinder having the same diameter D1 as the bottle body 3.

Regarding the example of FIG. 10, the body 3 which has a general squared cross-section is also inscribed in an imaginary cylinder and it can be seen that the label portion L protrudes from such an imaginary encasing body 13.

It can be seen in the FIGS. 1, 8-9 and 11-12 that the free end 12 of the label portion L entirely extends outside the imaginary cylinder. Alternatively, the free end 12 can be pasted on the bottle 1, thus extending at or near the periphery of the imaginary cylinder. With effect of gravity, the free end 12 of the label portion L extends under the level of the reinforcing portion 10 and the label information may also be read from a position laterally offset relative to the bottle 1. Accordingly, as compared to information displayed on a top surface of a conventional screw cap, visibility form a lateral point of view is increased at least for information of the label portion L displayed adjacent to the free end 12 (eye-catching display without maximizing the label). This is especially true for bottles stored in store shelves or racks where the top of the bottles 1 is adjacent an upper plate.

Figure 11:
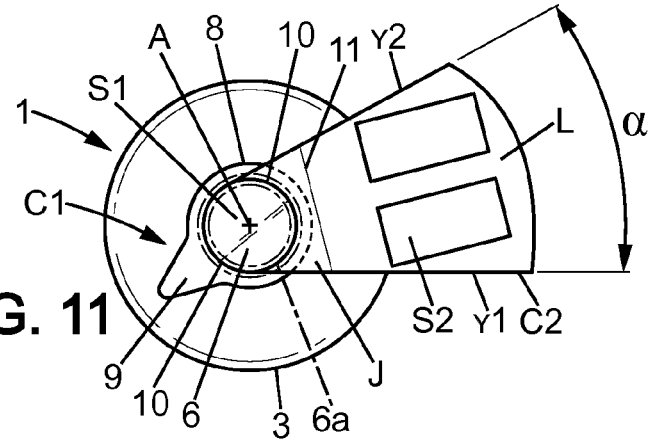
FIG. 11 is a top view of a liquid filled bottle in accordance with a sixth embodiment of the invention.

With such a configuration of the cover member C, a liquid filled bottle 1 may be provided with only one label defined by said label portion L (and optionally with the top face of the reinforcing portion 10, which is integrally made with the label portion L). As a result, with a body 3 made of a transparent plastic material as shown in FIGS. 3 and 5, the liquid 15 is entirely visible through the walls of the body 3. In other words, the body 3 is not covered by any additional layer of material and a bottle can be produced with one step less. Should a need exist for adding more information, a sleeve label 14 can be provided as in the exemplary embodiment of FIG. 9. Alternatively or additionally, the label portion L may be enlarged near the free end 12 as shown in FIG. 9 or FIG. 11, in order to increase the useful surface S2 for displaying label information.

Referring to FIGS. 1, 3-5, 7-9 and 11, it should be understood that the optional tab 9 has a length sufficient to allow said central portion 6 to be peeled off remotely by pulling the free end 9*a* of the tab 9 but have a size much smaller than the offset label portion L of the label element C2. In particular, the free end 9*a* is arranged within the imaginary cylinder defined by the body 3. The bigger dimension of the tab 9 may be about 8 mm, while the distance x2+x3 as shown in FIG. 2 between the annular fixing portion 6*a* 6*a* and the free end 12 of the label portion L is at least equal to 20 mm.

The reinforcing portion 10 and the central portion 6 can have a circular shape or the like. In the closing element C1, the outer diameter of the annular fixing portion 6*a* (delimiting the central portion 6) is here slightly superior to the diameter D5 of the opening 5. The diameter D5 can be typically of higher than 12 mm, preferably higher than 15 mm, for example from 15 to 20 mm or from 20 mm to 25 mm, or from 25 to 30 mm. The annular area defined by the annular fixing portion 6*a* can have a width of from 1 to 15 mm, preferably from 2 to 10 mm, preferably from 3 to 5 mm. The outer diameter of the annular fixing portion 6*a* can be of higher than 15 mm, preferably of higher than 20 mm, for example of from 20 to 23 mm, or of from 23 to 25.5 mm, or of from 25.5 to 27.5 mm, or of from 27.5 mm to 30 mm, or of from 30 mm to 35 mm. The fixing annular area 6*a* thus can have an outer perimeter higher than about 45 mm, preferably of higher than 60 mm. A large width can be useful in making the fixing easier.

Figure 8:
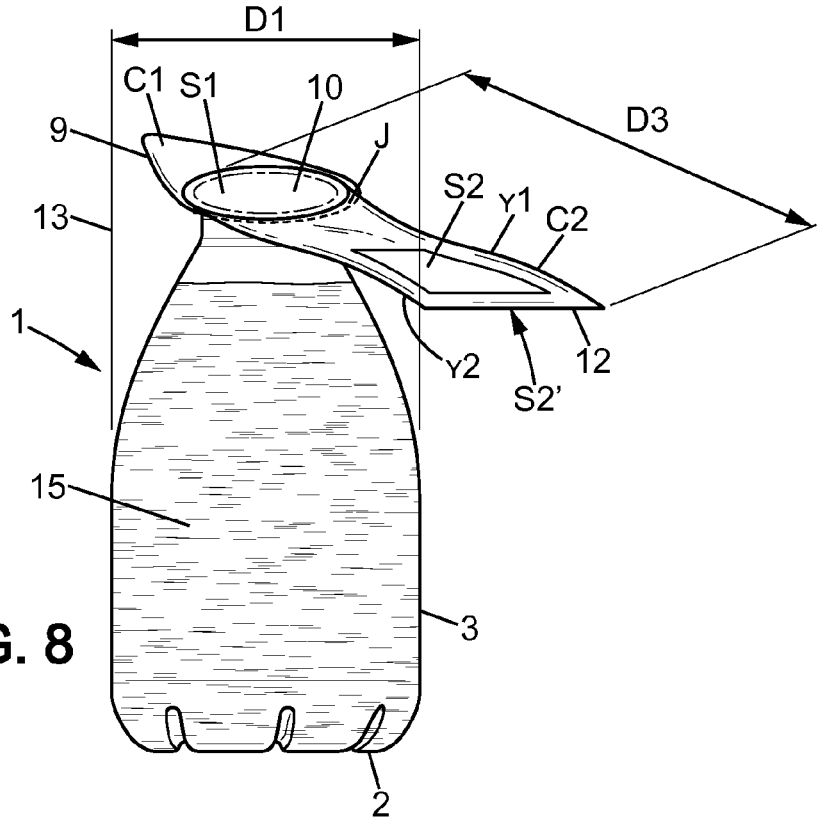
FIG. 8 shows a combination of the plastic bottle of FIG. 5 with a cover member, in accordance with a third embodiment of the invention.
Figure 9:
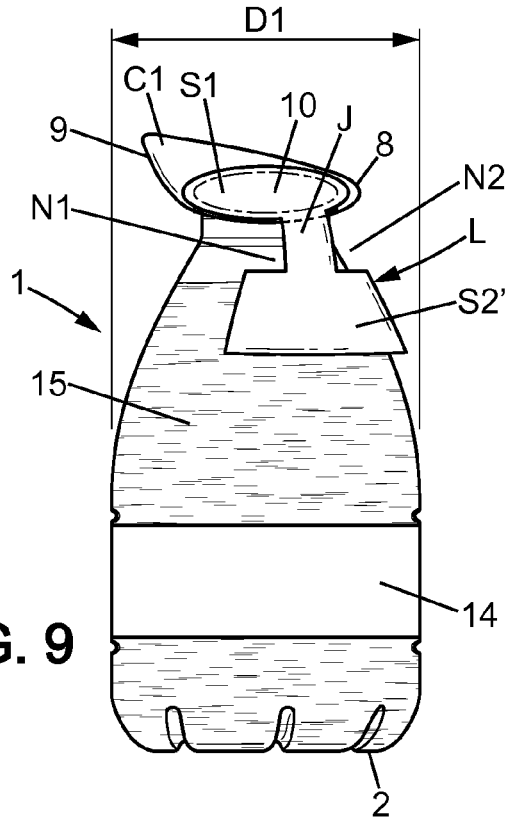
FIG. 9 shows a liquid filled bottle in accordance with a fourth embodiment of the invention.
Figure 10:
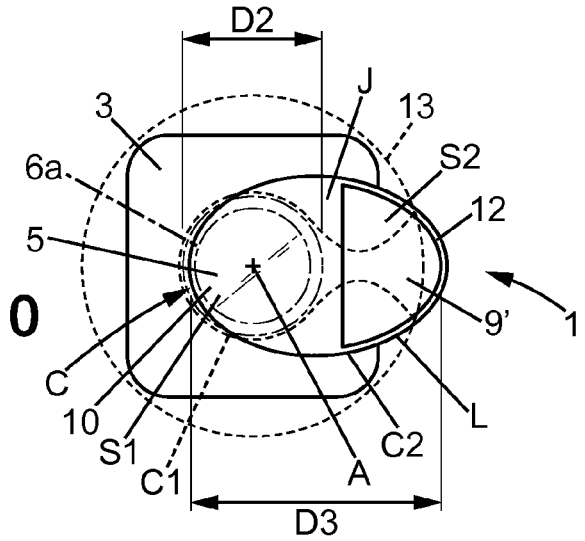
FIG. 10 is a top view of a liquid filled bottle in accordance with a fifth embodiment of the invention.

In the embodiments shown in FIGS. 1, 3-5 and 8-11, the label portion L has an elongated form, rectangular, elliptic or trapezoidal. Referring to FIGS. 8-10, the length D3 of the label portion L is for instance superior or equal to the diameter D1 of the imaginary cylinder or similar imaginary encasing body 13. The distance between the free end 12 and the longitudinal axis A also may be superior to the diameter D1.

Figure 12:
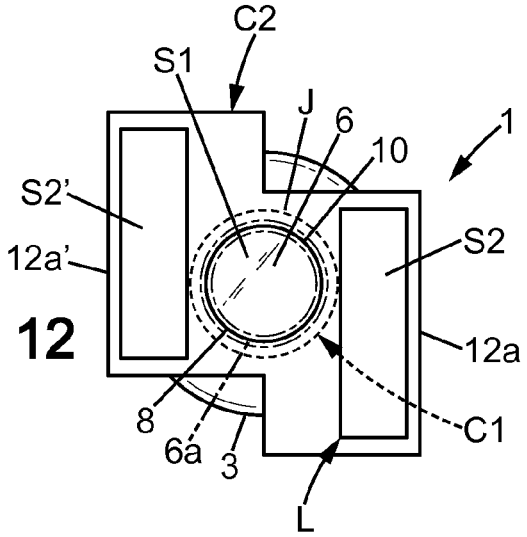
FIG. 12 is a top view of a liquid filled bottle in accordance with a seventh embodiment of the invention.

Referring to FIG. 4, the characteristic size x1 of the closing element C1, which may be slightly superior to the diameter D2 when the ring 4*a* has a circular shape, is here not superior to the distance x2. As label information extends along this distance x2, the label portion L is particularly suitable to display all the composition data related to the content of the bottle 1. It can be seen that this configuration of the cover member C with an elongated label portion L is used in the embodiments shown in FIGS. 1, 3-5, 8-9 and 11. Alternatively as shown in FIGS. 7, 10 and 12, the distance x2 may be shorter with a length of the free end 12 which remains sufficiently high so that the label portion L has a size significantly higher than a tip-like pull tab 9 as shown in FIGS. 1, 3-5 and 7-9.

Referring to FIG. 7, the label element C2 has a smaller label portion L that is provided with a surface S2 (here visible from the top) at least equal to half of the surface S1 (also visible from the top) defined by the reinforcing portion 10. This label portion L displays information, whereas the surface S1 may be also used for displaying information. The pull tab 9 of the closing element C1, which is shorter than the label portion L and has a triangular shape suitable for gripping, is used to remove the cover member C. The free end 12 of the label portion L here does not protrude beyond the imaginary cylinder as above defined but is adjacent to such an imaginary cylinder.

In the third and fourth embodiments shown in FIGS. 8-9, the label portion L protrudes as in the first embodiment beyond the cylindrical volume defined by the body 3 and comprises two rectilinear parallel sides y1, y2. The label portion L is formed as a side extension of the reinforcing portion 10, the label portion L extending only toward one direction so that it would be possible to form a pack with rows of identical bottles 1, in which the respective label portions L can be oriented in a general direction perpendicular to the general direction defined by the rows. In FIG. 8, the junction portion J is not defined between notches N1, N2 as in the first embodiment and the label portion L. The pull tab 9 defines the lifting means for removing the cover member C.

The fourth embodiment of the liquid filled bottle 1 shown in FIG. 9 mainly differs from the third embodiment shown in FIG. 5 in that the free end 12 is enlarged and a sleeve label 14 is provided. Furthermore, the junction J is narrowed by notches N1, N2. Of course, the sleeve label 14 can be removed from the fourth embodiment or can be used in any one of the other embodiments.

Now referring to FIG. 10, a fifth embodiment is shown in which the body 3 has a generally squared cross-section, inscribed in an imaginary encasing body 13 that corresponds to a cylinder. The narrow opening 5 is here circular but any other suitable shape could be used. For instance, the narrow opening 5 could be triangularly shaped to form a spout.

The free end 12 of the label portion L protrudes beyond this imaginary encasing body 13. The label element C2 made of the single piece multilayer film has an elliptic shape with the long axis defining the length D3 of the cover member C. The reinforcing portion 10 is arranged in a first half of the ellipse and the surface S2 for displaying label information is located in the second half, so that this second surface S2 is entirely offset relative to the annular fixing portion 6*a* used for the fixing of the closing member C1. The surface S1 arranged in the first half may be also used to display information. It can be seen that the ratio between the diameter D2 and the length D3 is here inferior to 2:3.

The cover member C can be removed by pulling the pull tab 9' that here extends below the label portion L. The label portion L adheres to the pull tab 9'. Accordingly, the cover member C defines a flexible lid, wherein the large flap defined by superimposition of the pull tab 9' and the label portion L can be easy gripped and makes the opening operation particularly easy for the user as the opening 5 is narrow.

Referring to the sixth embodiment shown in FIG. 11, the cover member C is here provided with a label element C2 having a label portion L tapered toward the longitudinal axis A. The free end 12 is enlarged and two significant areas or surfaces S2, S2' of the label portion L are used for displaying information. Use of at least two identical surfaces cane be useful for instance when two languages have to be used to display information (for instance in a country/state having two official languages).

Here, the rectilinear sides y1, y2 are convergent and define an angle α of approximately between 30 and 60°. More generally a cover member C with a label portion L extending along a large fraction of the circumference 8 of the closing element C1 may be provided and an angle of at least 30° is defined by the two opposite sides y1, y2. A hinge 11, rectilinear or curved, may be optionally defined at the junction portion J. Such a hinge allows folding of the label portion L without impact for the reinforcement exerted by the reinforcement portion 10 onto the central portion 6 in the annular fixing portion 6*a*.

The free end 12*a* of the label portion L can be pasted on the bottle 1 through a removable fixing, for instance using a paste. The paste material may be fixed more strongly to either the bottle 1, or the back of the label portion L.

Referring to FIG. 12, a seventh embodiment is shown, in which the label element C2 of the cover member C extends on two opposite sides of the closing element C1. Two surfaces S2, S2' are thus defined near respective two free ends 12*a*, 12*a'* of the label portion L. Should two languages be used to display information, this arrangement permits to modify placement of the bottle 1 (a first side for a first language and a second side opposite the first side for a second language). The reinforcing portion 10 here defines a central portion of the label element C1 and not an end as in the previous embodiments. The reinforcing portion 10 typically extends in a horizontal plane parallel to the central portion 6 of the closing element C1. Because of the flexibility of the label portion L, the label portion L extends around the neck 4 and essentially below the top of the neck 4. It should be understood that the label portion L may define a polygon with a plurality of outer rectilinear edges, ellipse or any suitable shape.

Figure 14:
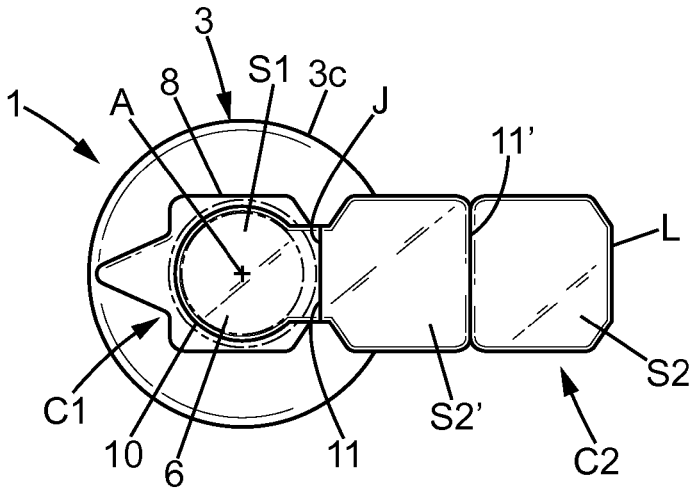
FIG. 14 is a top view of a liquid filled bottle in accordance with an eighth embodiment of the invention.

Referring to the eighth embodiment shown in FIG. 14, the cover member C is here provided with a label element C2 having at least two parallel hinges 11, 11'. Before unfolding, the intermediate portion with the surface S2' extends above the reinforcing portion 10 and the end portion with the surface S2 extends above the intermediate portion, the cover member C being in a compact folded state. The label element C2 is optionally marked with ink printing on two respective opposite faces of the label portion L. As apparent in FIG. 14, a same so-called outer face can be seen (from the top) when the label portion L is in an unfolded state. In a slight variant, non parallel hinges 11, 11' (for instance obtained with perpendicular fold lines) and/or additional portions with parallel or non parallel hinges may be provided.

A fixing material may be provided on the opposite inner face, at the reinforcing portion 10. It can be seen that each of the foldable portions, here the intermediate portion and the end portion, may have the same size and the same overall shape. An optional tab (not shown) may be provided as an extension of the end portion to make the unfolding easier. Such tab protrudes in the folded state and thus may be used for actuating the unfolding. Of course, the reinforcing portion 10 to be covered by the foldable portions may have different shapes and can be provided with an opening 10*a* as shown in FIG. 13.

The present invention has been described in connection with the preferred embodiments. These embodiments, however, are merely for example and the invention is not restricted thereto. It will be understood by those skilled in the art that other variations and modifications can easily be made within the scope of the invention as defined by the appended claims, thus it is only intended that the present invention be limited by the following claims. Of course, the bottle 1 is not in any way limited to flat or sparkling mineral water but can be intended to contain all sorts of flowable products, edible or inedible liquids of greater or lesser fluidity such as, for example, fruit juices, milk-based beverages such as milk or dairy fermented products (for example yogurts), etc., and also sauces or condiments (ketchup, mustard, dressing, etc.) or non-food liquids (deionised water, cleaning products, detergents, etc.). The term "liquid" should thus not be interpreted in a restricted manner as the plastic container could be filled with any flowable product. Also, the size of the restricted aperture of the bottle 1 may be adjusted.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

The invention claimed is:

1. A liquid filled bottle, comprising a cover member and a plastic bottle having a body, a rigid neck and a narrow opening sealed by the cover member, the narrow opening being defined in the upper face of the neck and surrounded by a ring of the neck, the cover member comprising:

a one piece flexible closing element consisting essentially of a peelable film and comprising:

i) a central portion adhering with said ring and sealing the narrow opening of the bottle, and ii) at least one margin portion extending around the central portion, the closing element having a circumference at least partly defined by said margin portion; and a one piece flexible label element defined by at least one layer of film material, said label element including a label portion;

wherein the closing element has a top face delimited by said circumference and defining a planar support surface;

wherein said label element comprises a reinforcing portion directly fastened to all or a part of said support surface and entirely or partly covering said central portion, with the provision that at least an annular fixing portion covering the ring is covered by the reinforcing portion, the reinforcing portion defining a first surface;

and wherein the label portion defines a second surface that is entirely offset relative to the upper face of the neck, the ratio between the second surface and the first surface being superior or equal to 1:2.

2. The liquid filled bottle according to claim 1, wherein the closing element comprises a pull tab adapted for removing the cover member from the ring of the neck, the pull tab protruding radially outwards beyond said ring.

3. The liquid filled bottle according to claim 2, wherein said pull tab has a free end that extends at a distance from the label element.

4. The liquid filled bottle according to claim 1, wherein the body of the bottle extends around a longitudinal axis, the closing element intersecting said longitudinal axis.

5. The liquid filled bottle according to claim 4, wherein the body determines an imaginary cylinder extending longitudinally around said longitudinal axis, and wherein said label portion comprises a free end, optionally pasted on the bottle, said free end entirely extending outside said imaginary cylinder when the free end is not pasted on the bottle.

6. The liquid filled bottle according to claim 5, wherein said label portion comprises a free end, the distance between said free end and said longitudinal axis being superior to the diameter of said imaginary cylinder.

7. The liquid filled bottle according to claim 6, wherein said closing element entirely extends within said imaginary cylinder.

8. The liquid filled bottle according to claim 1, wherein the ratio between the second surface and the first surface is at least 1:1.

9. The liquid filled bottle according to claim 1, wherein said closing element is a plastic film.

10. The liquid filled bottle according to claim 1, wherein said closing element is a peelable film having a thickness inferior or equal to 300 μm.

11. The liquid filled bottle according to claim 10, wherein said label element has a thickness inferior or equal to 100 μm.

12. The liquid filled bottle according to claim 10, wherein said closing element has a thickness, which is constant and is comprised between 5 and 200 μm.

13. The liquid filled bottle according to claim 1, wherein the neck has a tubular shape and comprises an outer face extending downwardly from the ring, said ring protruding radially outwards from the outer face.

14. The liquid filled bottle according to claim 1, wherein said reinforcing portion defines a disc-shaped crown having a determined diameter, and wherein said label portion comprises a free end provided with an edge having a length superior or equal to said determined diameter.

15. The liquid filled bottle according to claim 1, wherein the reinforcing portion essentially extends in a first plane, said label element comprising a junction portion adjacent said ring and arranged between the reinforcing portion and the label portion so as to cover a fraction of said margin portion of the closing element, said junction portion being narrower than the label portion.

16. The liquid filled bottle according to claim 15, wherein the junction portion is arranged between two notches to form a hinge.

17. The liquid filled bottle according to claim 1, wherein said label element is marked with ink printing on two second surfaces defined on two respective opposite faces of said label portion.

18. The liquid filled bottle according to claim 1, wherein the bottle is obtained by stretch-blow molding an injection-molded preform, the body being connected to the rigid neck of the bottle by a flexible shoulder, the label portion being pasted on said shoulder at a distance from the neck.

19. The liquid filled bottle according to claim 18, only comprising a single label defined by said label portion, the body being transparent and not covered by any additional layer of material.

20. The liquid filled bottle according to claim 1, wherein the central portion of the closing element is fixed on the ring of the neck by heat sealing.

21. A liquid filled bottle, comprising a cover member and a bottle having a body, a plastic rigid neck and a opening sealed by the cover member, the opening being defined in the upper face of the neck and surrounded by a ring of the neck, the cover member comprising:

a one piece flexible closing element consisting of a peelable plastic film and comprising:

i) a central portion adhering with said ring and sealing the opening of the bottle, and ii) at least one margin portion extending around the central portion, the closing element having a circumference at least partly defined by said margin portion; and a one piece flexible label element defined by at least one layer of film material, said label element including a label portion;

wherein the opening has a largest dimension inferior to 40 mm;

wherein the closing element has a top face delimited by said circumference and defining a planar support surface;

wherein said label element comprises a reinforcing portion directly fastened to all or a part of said support surface and entirely or partly covering said central portion, with the provision that at least an annular fixing portion covering the ring is covered by the reinforcing portion, the reinforcing portion defining a first surface;

and wherein the label portion defines a second surface that is entirely offset relative to the upper face of the neck, the ratio between the second surface and the first surface being superior or equal to 1:2.

* * * * *